US010210959B2

(12) United States Patent
Stevick et al.

(10) Patent No.: US 10,210,959 B2
(45) Date of Patent: Feb. 19, 2019

(54) RADIATION SHIELDING STRUCTURES

(75) Inventors: Joseph Stevick, North Tustin, CA (US); Theodore Andrew Waniuk, Lake Forest, CA (US); Tran Quoc Pham, Anaheim, CA (US)

(73) Assignee: Crucible Intellectual Property, LLC, Rancho Santa Margarita, CA (US)

( * ) Notice: Subject to any disclaimer, the term of this patent is extended or adjusted under 35 U.S.C. 154(b) by 885 days.

(21) Appl. No.: 14/348,404

(22) PCT Filed: Sep. 29, 2011

(86) PCT No.: PCT/US2011/053827

§ 371 (c)(1),
(2), (4) Date: May 6, 2014

(87) PCT Pub. No.: WO2013/052024

PCT Pub. Date: Apr. 11, 2013

(65) Prior Publication Data

US 2014/0284503 A1 Sep. 25, 2014

(51) Int. Cl.

| | |
|---|---|
| ***C22C 1/00*** | (2006.01) |
| ***G21F 1/06*** | (2006.01) |
| ***G21F 1/08*** | (2006.01) |
| ***G21F 3/00*** | (2006.01) |
| ***G21H 5/02*** | (2006.01) |
| ***C22C 45/00*** | (2006.01) |
| ***C22C 45/10*** | (2006.01) |

(52) U.S. Cl.

CPC ..... *G21F 1/08* (2013.01); *C22C 1/002* (2013.01); *C22C 45/001* (2013.01); *C22C 45/003* (2013.01); *C22C 45/10* (2013.01); *G21F 1/06* (2013.01); *G21F 3/00* (2013.01); *G21H 5/02* (2013.01)

(58) Field of Classification Search

CPC ..... G21F 1/08; G21F 1/085

See application file for complete search history.

(56) References Cited

U.S. PATENT DOCUMENTS

| | | | |
|---|---|---|---|
| 5,288,344 | A | 2/1994 | Peker et al. |
| 5,368,659 | A | 11/1994 | Peker et al. |
| 5,618,359 | A | 4/1997 | Lin et al. |
| 5,735,975 | A | 4/1998 | Lin et al. |
| 6,325,868 | B1 | 12/2001 | Kim et al. |
| 7,575,040 | B2 | 8/2009 | Johnson |
| 8,480,864 | B2 | 7/2013 | Farmer et al. |
| 2006/0260782 | A1 | 11/2006 | Johnson |
| 2007/0003782 | A1 | 1/2007 | Collier |
| 2007/0226979 | A1 | 10/2007 | Paton et al. |
| 2007/0252771 | A1 | 11/2007 | Maezawa et al. |
| 2008/0188886 | A1 | 8/2008 | Kusleika et al. |
| 2009/0053476 | A1 | 2/2009 | Conner et al. |
| 2010/0263766 | A1* | 10/2010 | Saw ..... B22F 9/005 148/403 |

FOREIGN PATENT DOCUMENTS

| | | | | |
|---|---|---|---|---|
| EP | 0055371 | | 7/1982 | |
| GB | 2370918 | A * | 7/2002 | ..... H01Q 1/245 |
| JP | 2001303218 | | 10/2001 | |
| WO | 99/43005 | | 8/1999 | |

OTHER PUBLICATIONS

Huang et al. "A new Ti—Zr—Hf—Cu—Ni—Si—Sn bulk amorphous alloy with high glass-forming ability" Journal of Alloys and Compounds, 2007, 427, 171-175.*

International Preliminary Report on Patentability (IPRP), dated Apr. 10, 2014.

International Search Report and Written Opinion, dated Jul. 26, 2012, PCT/ISA/210, PCT/ISA/220, PCT/ISA/237, total of 17 pages.

Biocompatibility, Wikipedia, retrieved from https://en.wikipedia.org/w/index.php?title+Biocompatibility&oldid=429689815, 6 pages.

Hays et al., "Microstructure Controlled Shear Band Pattern Formation and Enhanced Plasticity of Bulk Metallic Glasses Containing in situ Formed Ductile Phase Dendrite Dispersons," *Physical Review Letters,* 2000, vol. 84, p. 2901.

Inoue et al., Bulk amorphous alloys with high mechanical strength and good soft magnetic properties in Fe-TM-B (TM=IV-VIII group transition metal) system, *Appl. Phys. Lett.,* 71 (4), 1977, pp. 464-466.

Shen et al., Bulk Glassy $Co_{43}Fe_{20}Ta_{5.5}B_{31.5}$ Alloy with High Glass-Forming Ability and Good Soft Magnetic *Properties, Materials Transactions,* vol. 42, No. 10, 2001, pp. 2136-2139.

* cited by examiner

*Primary Examiner* — Peter F Godenschwager

(74) *Attorney, Agent, or Firm* — Brownstein Hyatt Farber Schreck, LLP

(57) ABSTRACT

Radiation shielding structures comprising bulk-solidifying amorphous alloys and methods of making radiation shielding structures and components in near-to-net shaped forms are provided.

17 Claims, 10 Drawing Sheets

ELECTRO-MAGNETIC RADIATION

PARTICLE RADIATION

Figure 3 – Items (1) to (7)
FORMS OF SHIELDING STRUCTURES
Item 1: BULK
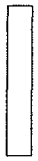
Item 2: FOIL
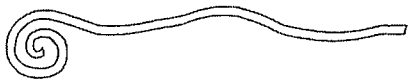
Item 3: PLATING
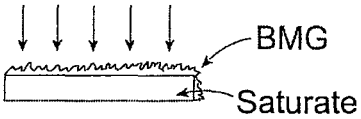
– Patterned for transmission/receptor, tuning or other reason
Item 4: BLOW MOLDED FORMS
– Protect Inside
– Protect Outside
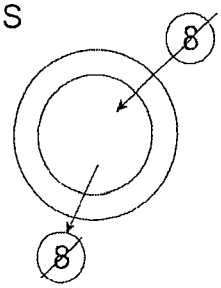
Item 5: HOT FORMED SHAPES
– Sealed Containers
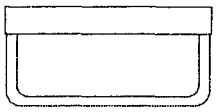

Figure 3 – Items (1) to (7)
FORMS OF SHIELDING STRUCTURES
Item 6: MESH
– Faraday Cages
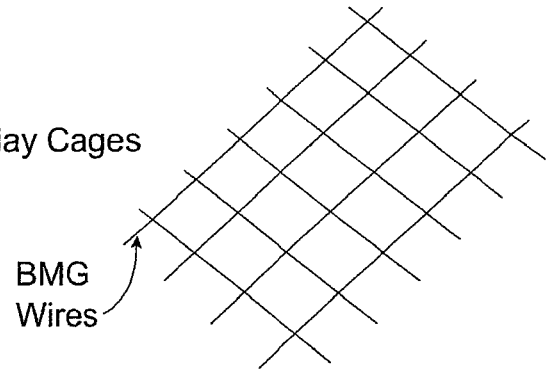
Item 7: RF GUIDES
– Micropatterned
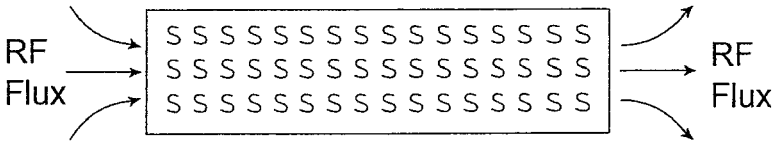
– Left Handed
– Right Handed
– RF, Optical Figure 4
| | Zirconium Based BMG | Copper |
|---|---|---|
| Mass Magnetic Susceptibility ($\chi$) | $1.09 \times 10^{-6}$ $m^3/Kg$ | $9.2 \times 10^{-6}$ $m^3/Kg$ |
| Images as seen by MRI | 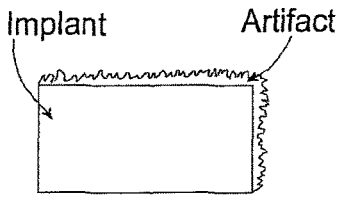  | 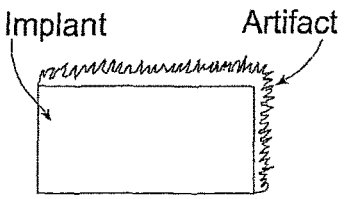  |
| Stability | High Corrosion Resistance | Low Corrosion Resistance |
| Density | Variable - High to Low | Fixed |

Figure 5
MICROELECTRONICS
- Surface Mount Type
- Standard Footprint
- Board Level
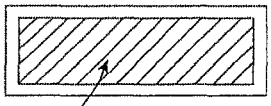
Resistors, Capacitors, Integrate Circuit, etc.
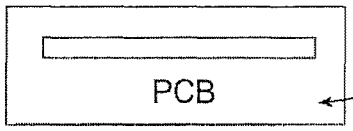
Amorphous Glassy
Metal Layer Coating
- Complete Device Level
  - Phones
  - Microphones
  - Motors
  - Transmitters/Receivers

RADIATION SHIELDING STRUCTURES

All publications, patents, and patent applications cited in this Specification are hereby incorporated by reference in their entirety.

FIELD OF THE INVENTION

The present invention relates to radiation shielding and influencing structures comprising bulk-solidifying amorphous alloys and methods of making radiation shielding structures and components in near-to-net shaped forms.

BACKGROUND

Radiation shielding, sometimes known as radiation protection and radiological protection, is the science of protecting people and the environment from the harmful effects of ionizing radiation, which includes both particle radiation and high energy electromagnetic radiation. Ionizing radiation is widely used in industry and medicine, but presents a significant health hazard. It causes microscopic damage to living tissue, resulting in skin burns and radiation sickness at high exposures and statistically elevated risks of cancer, tumors and genetic damage at low exposures. In practice, radiation shielding includes influencing the propagation of radiation in other ways: scattering, collimating, focusing, re-directing, or encapsulating.

It has been argued that it is very difficult to make simple radiation shielding structures because different radiation types interact with condensed matter (solid materials) in a unique ways. Different types of ionizing radiation behave in different ways, therefore different shielding techniques must be used. Particle radiation includes a stream of charged or neutral particles, both charged ions and subatomic elementary particles. This includes solar wind, cosmic radiation, and neutron flux in nuclear reactors. Alpha particles (helium nuclei) are the least penetrating. Even very energetic alpha particles can be stopped by a single sheet of paper. Beta particles (electrons) are more penetrating, but still can be absorbed by a few millimeters of aluminum. However, in cases where high energy beta particles are emitted shielding must be accomplished with low density materials, e.g. plastic, wood, water or acrylic glass (Plexiglas, Lucite). This is to reduce generation of Bremsstrahlung X-rays. In the case of beta+radiation (positrons), the gamma radiation from the electron-positron annihilation reaction poses additional concern.

Neutron radiation is not as readily absorbed as charged particle radiation, which makes this type highly penetrating. Neutrons are absorbed by nuclei of atoms in a nuclear reaction. This most-often creates a secondary radiation hazard, as the absorbing nuclei transmute to the next-heavier isotope, many of which are unstable. Cosmic radiation is not a common concern, as the Earth's atmosphere absorbs it and the magnetosphere acts as a shield, but it poses a problem for satellites and astronauts and frequent fliers are also at a slight risk. Cosmic radiation is extremely high energy, and is very penetrating. Electromagnetic radiation includes emissions of electromagnetic waves, the properties of which depend on the wavelength. X-ray and gamma radiation are best absorbed by atoms with heavy nuclei; the heavier the nucleus, the better the absorption. In some special applications, depleted uranium is used, but lead is much more common; several centimeters are often required. Barium sulfate is used in some applications too. However, when cost is important, almost any material can be used, but it must be far thicker. Most nuclear reactors use thick concrete shields to create a bioshield with a thin water cooled layer of lead on the inside to protect the porous concrete from the coolant inside. The concrete is also made with heavy aggregates, such as Baryte, to aid in the shielding properties of the concrete. Ultraviolet (UV) radiation is ionizing but it is not penetrating, so it can be shielded by thin opaque layers such as sunscreen, clothing, and protective eyewear. Protection from UV is simpler than for the other forms of radiation above, so it is often considered separately. In some cases, improper shielding can actually make the situation worse, when the radiation interacts with the shielding material and creates secondary radiation that absorbs in the organisms more readily.

Radiation from radioactive isotopes or radionuclides generally consists of high-energy particles or rays emitted during the nuclear decay process. Such radiation generally does not include non-ionizing radiation, such as radio-microwaves, visible, infrared, or ultraviolet light. However, radiation from spontaneous nuclear decay mechanisms can produce alpha particles, beta particles, gamma rays, high energy X-rays, neutrons, high-speed electrons, high-speed protons, and other particles, which are capable of producing ions. Among these emissions, gamma and high energy X-ray radiation are the most common forms of hazardous radiation to which biological organisms, sensitive electronics, etc. are exposed (whether the radiation is manmade or naturally occurring), and therefore most commonly require unique and efficient shielding solutions.

It is well-known that the effectiveness of atomic shielding mechanisms for gamma rays and high energy X-rays is dependent on the atomic number and the density of the shielding material. A denser shielding material with a higher atomic number is a better shielding material for high energy X-rays and gamma rays. For example, lead is heavier than roughly 80 percent of the elements in the periodic table and has a high atomic number; and therefore is the primary material used in most radiation shielding structures. Although, there are other elements with higher densities, such as tantalum and tungsten, lead is chosen because it is readily available, easily fabricated, and has a lower cost.

In the past high energy (ionizing) radiation shielding structures have generally been large-sized structures such as buildings and bulk containers that can be used to house the radiation source. As a result stringent demands have not been placed on the materials' structural properties other than the materials' general effectiveness for radiation shielding. Therefore, concrete and lead have been acceptable materials for constructing such large-scale structures.

However, conventional radiation shielding structures made of lead and concrete are inadequate for the increasingly sophisticated uses of high energy radiation found in some processes and applications. For example, the use of radiation in areas such as medical treatment, and food sterilization requires radiation shielding structures with similar or better performance characteristics than traditional concrete and lead, but made of high-performance high-strength materials. In addition, in some of these applications it is desired to direct radiation into highly localized regions, as in brachytherapy. These structures need to be highly compact and slender, while also requiring high structural integrity and high effectiveness for radiation shielding. Moreover, new radiation shielding structures incorporating moving parts, or having resistance to corrosive environments, or that are bio-compatible, or that have high structural integrity in complex shapes are needed in order to proliferate the use of radioactive radiation in these diverse applications. For example, radiation-shielding structures can take an infinite variety of different shapes and sizes, such as canisters, enclosures, frames, moving parts in various structures and machinery equipment. Ideally, the shielding structure is a topologically continuous uniform structure. However, in order to perform various functions, such as injecting measured doses of radiation in certain directions or in a device with moving parts, the radiation shielding structure may only partly enclose the radioactive source or may have one or more components for performing peripheral functions. For example, a load lock device for a radioactive container may require frequent opening and closing and therefore, the structure may comprise several moving parts and frames. Generally, any such radiation shielding structure or its component still must attenuate the radiation to levels below a maximum allowable level to provide sufficient shielding protection external to the radioactive source. In another form, the radiation shielding structures can be used as a marker in radiography which preferentially blocks the path of radiation, such as imaging and locating orthopedic devices (stents etc.) in the body or locating tumors in Proton Beam Therapy. In this case, the radiography marker is desired to be highly biocompatible.

The main disadvantage of radiation shielding constructions made of lead is its toxicity and limited structural integrity. In contrast, typical engineering materials used in structures and machinery equipment such as steel, aluminum, and titanium do not have good shielding effectiveness and tend to be bulky. Applying other ordinary alloys to radiation shielding applications also has drawbacks. For example, tantalum is both low in mechanical strength and very expensive. Tungsten, on the other hand has higher strength, but is very difficult to fabricate into intricate shapes. Tungsten impregnated plastic has been developed for its formability and reduction in cost, however, its shielding effectiveness is significantly reduced compared to pure tungsten. Furthermore, plastics generally don't have adequate strength and therefore, compact and slender designs cannot be readily obtained. Plastics are also susceptible to environmental degradation.

Accordingly, there is a need to develop new radiation shielding structures providing effective radiation shielding that are corrosion resistant, bio-compatible, and can be formed into designs that are slender and compact with high structural integrity and durability.

A proposed solution according to embodiments herein for radiation shielding structure is to use bulk-solidifying amorphous alloys for radiation shielding. Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

SUMMARY

As explained above, there are different kinds of radiation that could require different kind of shielding. The embodiments herein include radiation shielding structures of bulk metallic glasses to shield low energy radiation like radiation in the radio frequency regime as shown in FIG. 2(*a*), which is in the kilohertz and megahertz region of the electromagnetic spectrum. These low-energy radiation shielding structures also shield visible light, infrared and UV because these structures are opaque to the frequencies of these radiations. The embodiments herein also include radiation shielding structures of bulk metallic glasses having extremely high density and very high atomic number for high energy radiation like X-rays and gamma rays, as well as alpha radiation, neutron radiation or even cosmic rays, which are essentially high energy photons that are higher frequency than the visible light regime as shown in FIG. 2(*b*). The radiation shielding structures of the embodiments herein could be effective for blocking both low energy and high energy particle radiation.

BRIEF DESCRIPTION OF THE DRAWINGS

FIG. 1(*b*) provides a schematic of a time-temperature-transformation (TTT) diagram for an exemplary bulk solidifying amorphous alloy.

FIG. 1(*c*) is a schematic of a radiation shielding structure according to one exemplary embodiment of the embodiments herein, where at least one component of the structure is made of radiation shielding bilk-solidifying amorphous alloy.

FIG. 1(*d*) is a flow chart of a method of manufacturing a radiation shielding structure in accordance with a first exemplary embodiment of the embodiments herein.

FIG. 1(*e*) is a flow chart of a method of manufacturing a radiation shielding structure in accordance with a second exemplary embodiment of the embodiments herein.

FIG. 2(*b*) provides a schematic of a bulk metallic glass (bulk solidifying amorphous alloy) used as a radiation shield for high energy radiation.

FIG. 3, Items 1 to 7, show different radiation shielding structures made of bulk solidifying amorphous alloys.

FIG. 4 compares the magnetic resonance imaging (MRI) results of a zirconium based bulk solidifying amorphous alloy and copper based medical implants.

FIG. 5 shows applications of bulk metallic glass for radiation shielding for electronics and microelectronics.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1A:
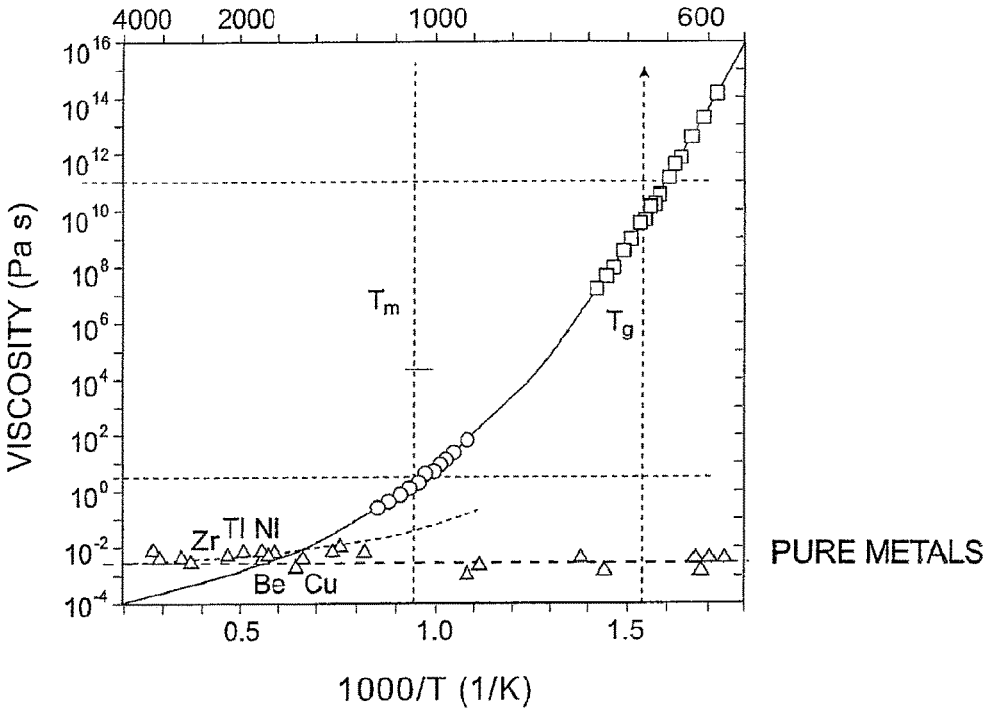
FIG. 1(*a*) provides a temperature-viscosity diagram of an exemplary bulk solidifying amorphous alloy.
Figure 1B:
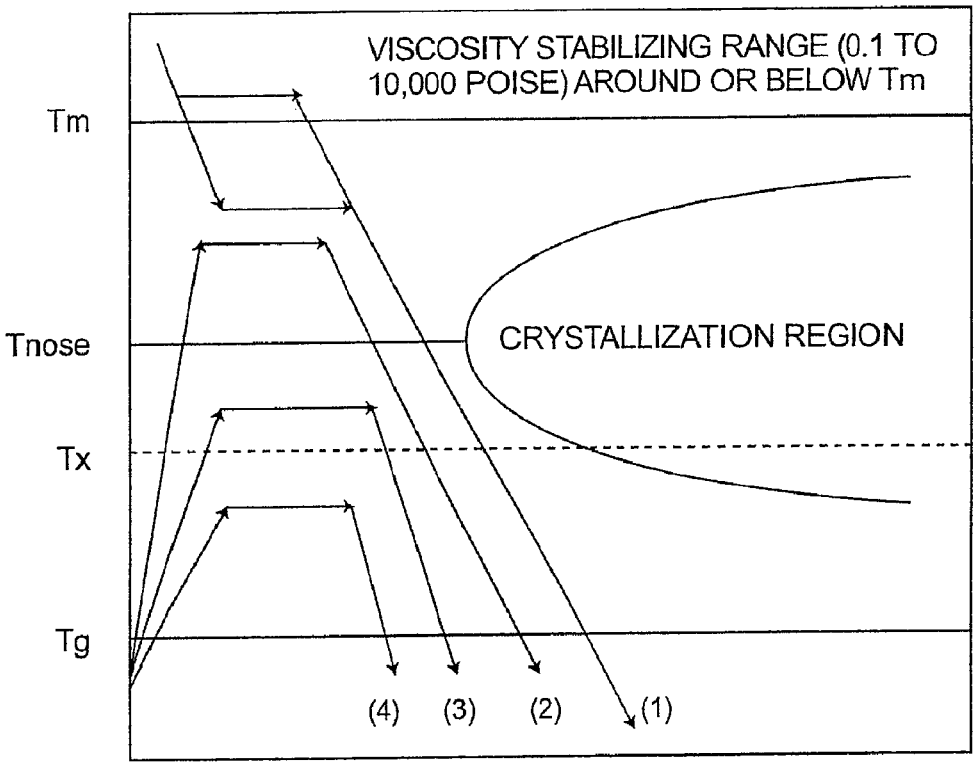
Figure 1C:
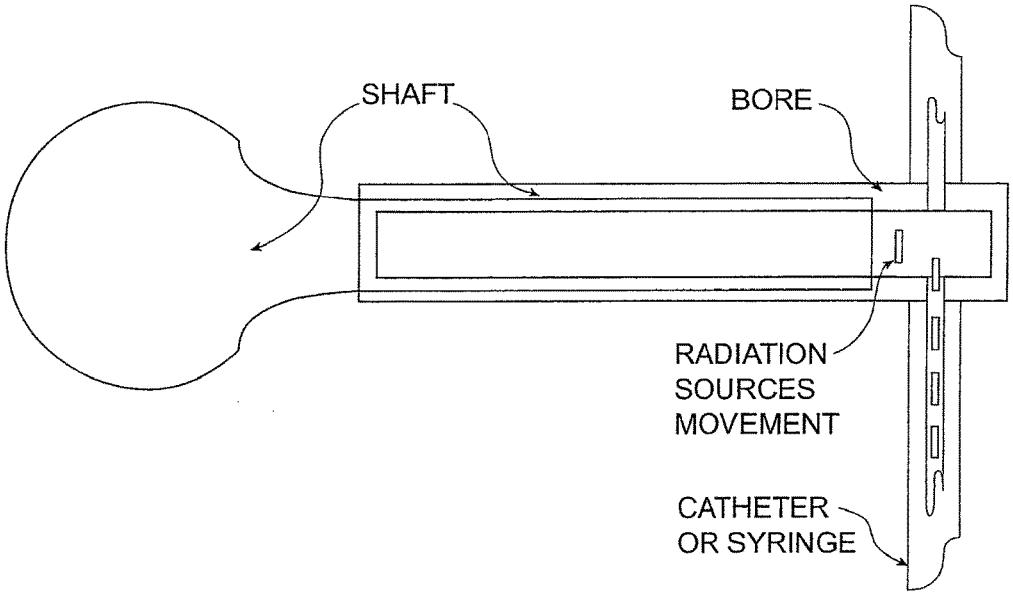
Figure 1D:
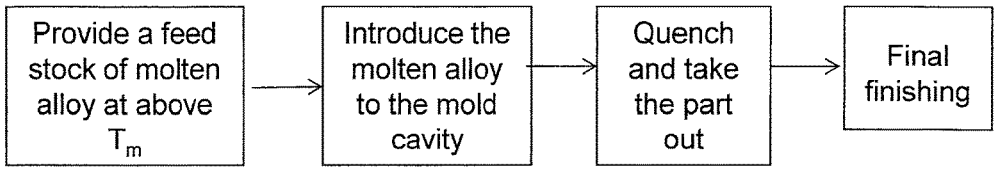
Figure 1E:
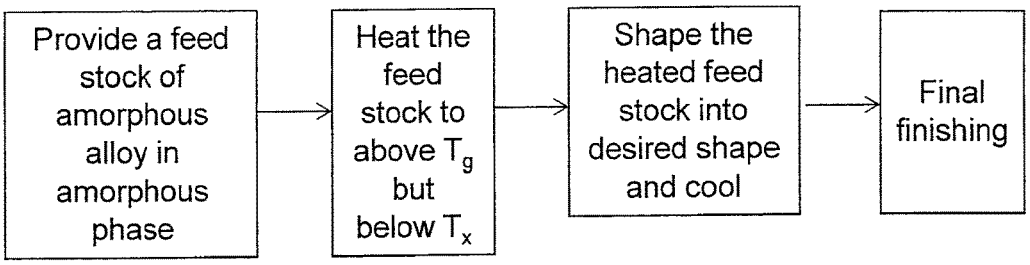
Figure 2A:
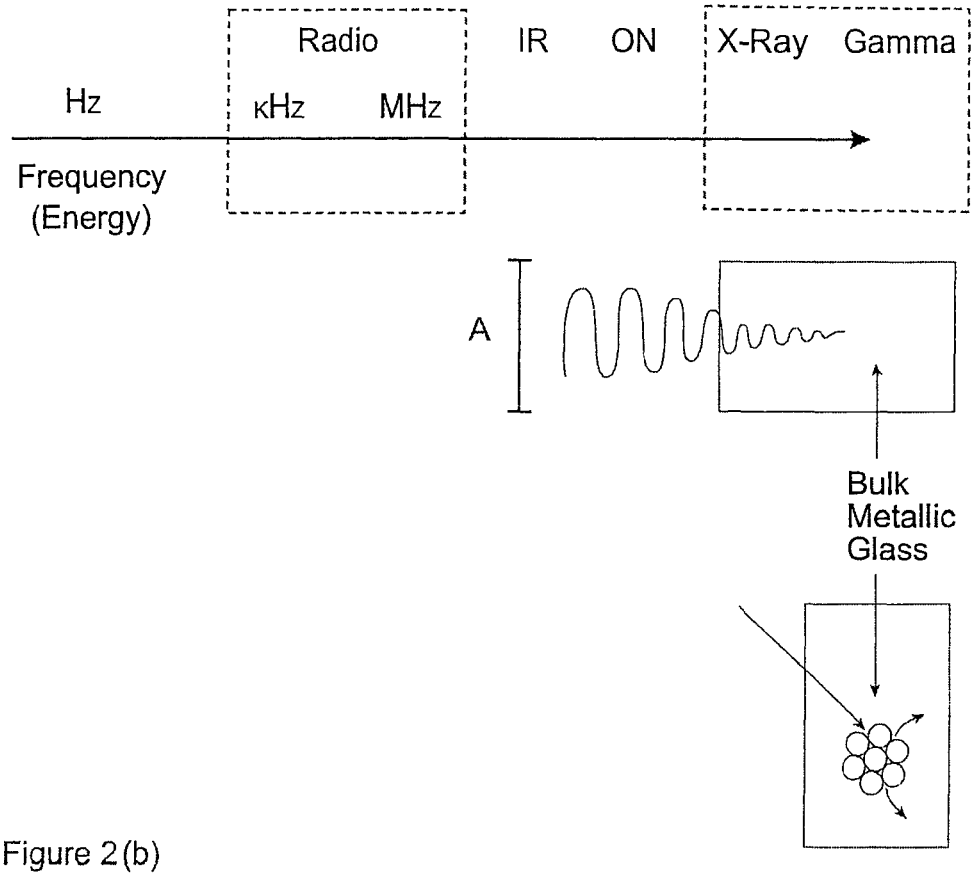
FIG. 2(*a*) provides a schematic of a bulk metallic glass (bulk solidifying amorphous alloy) used as a radiation shield for low energy radiation.
Figure 2B:
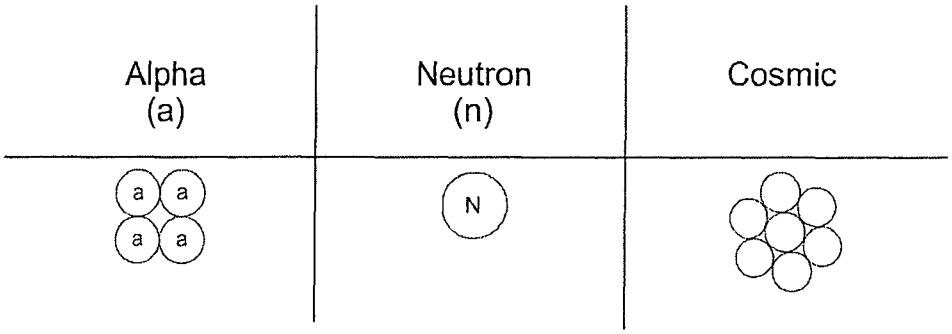

FIG. 1(*a*) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

FIG. 1(*b*) (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 1(*b*). In FIG. 1(*b*), the Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^{5}$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 1(*b*), Tx is shown as a dashed line as Tx can vary from close to Tm to close to Tg.

The schematic TTT diagram of FIG. 1(*b*) shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF), also referred to as thermoplastic forming, from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one could have not reached Tx.

Typical differential scanning calorimeter (DSC) heating curves of bulk-solidifying amorphous alloys taken at a heating rate of 20 degree C./min describe, for the most part, a particular trajectory across the TTT data where one could likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 1(*b*), then one could avoid the TTT curve entirely, and the DSC data could show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x, x')=\langle s(x), s(x')\rangle$.

In the above function, s is the spin quantum number and x is the distance function within the particular system. This function is equal to unity when x=x' and decreases as the distance |x−x'| increases. Typically, it decays exponentially to zero at large distances, and the system is considered to be disordered. If, however, the correlation function decays to a constant value at large |x−x'|, then the system can be said to possess long-range order. If it decays to zero as a power of the distance, then it can be called quasi-long-range order. Note that what constitutes a large value of |x−x'| is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}MO_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

TABLE 1

Exemplary amorphous alloy compositions

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | Sn | |
| | 50.75% | 36.23% | 4.03% | 9.00% | 0.50% | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Au | Ag | Pd | Cu | Si | |
| | 49.00% | 5.50% | 2.30% | 26.90% | 16.30% | |
| 13 | Au | Ag | Pd | Cu | Si | |
| | 50.90% | 3.00% | 2.30% | 27.80% | 16.00% | |
| 14 | Pt | Cu | Ni | P | | |
| | 57.50% | 14.70% | 5.30% | 22.50% | | |
| 15 | Zr | Ti | Nb | Cu | Be | |
| | 36.60% | 31.40% | 7.00% | 5.90% | 19.10% | |
| 16 | Zr | Ti | Nb | Cu | Be | |
| | 38.30% | 32.90% | 7.30% | 6.20% | 15.30% | |
| 17 | Zr | Ti | Nb | Cu | Be | |
| | 39.60% | 33.90% | 7.60% | 6.40% | 12.50% | |
| 18 | Cu | Ti | Zr | Ni | | |
| | 47.00% | 34.00% | 11.00% | 8.00% | | |
| 19 | Zr | Co | Al | | | |
| | 55.00% | 25.00% | 20.00% | | | |

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

Biocompatible

Biocompatible refers to the property of being biologically compatible by not having toxic or injurious effects on a biological system. As a result of its strength and biocompatibility, a biocompatible material can be used in a medical device. Biocompatibility is related to the behavior of biomaterials in various contexts. The term may refer to specific properties of a material without specifying where or how the material is used (for example, that it elicits little or no immune response in a given organism, or is able to integrate with a particular cell type or tissue), or to more empirical clinical success of a whole device in which the material or materials feature.

Radiation Shielding Structures

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC (Differential Scanning calorimetry) measurements at typical heating rates (e.g. 20° C./min) as the onset of crystallization temperature and the onset of glass transition temperature.

The amorphous alloy components of the radiation shielding structures can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_x$. The cooling step is carried out at rates similar to the heating rates at the heating step, and preferably at rates greater than the heating rates at the heating step. The cooling step is also achieved preferably while the forming and shaping loads are still maintained.

Electronic Devices

The above described investment casting can be valuable in the fabrication process involving using a BMG. In one embodiment, the presently described methods can serve as a quality control method to detect the presence of crystals in a BMG, thereby helping improvement of the system to minimize, or eliminate, the presence of crystals. BMG fabrication processes herein can, for example, be those that are used to make devices containing a BMG. One such type of device is an electronic device.

An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

The bulk metallic glass of the embodiments herein could be useful for stopping alpha radiation. In particular, the lack of structure of a BMG prevents premature breakdown of BMG shielding structures because the amorphous structure of a BMG could make a BMG less susceptible to damage by alpha particle radiation. That is, as there is no crystalline matrix or structure in a BMG to be degraded by the radiation once an alpha particle is embedded in a BMG, the BMG could hold up longer under the effects of alpha particle radiation than other crystalline metallic radiation shields. So that is a potential benefit for using bulk metallic glasses, at least when it comes to shielding alpha particles. For neutron and cosmic and other real high energy rays one would need a high density, high atomic number (also known as the proton number and conventionally represented by the symbol Z) bulk metallic glass, higher than that of lead. For radiations shielding structures for X-rays and gamma rays, one could use a material like lead, whose atomic number is 82 and density is 11.34 $g \cdot cm^{-3}$.

Bulk solidifying amorphous alloys of the embodiments herein can be cooled at cooling rates, of about 500 K/sec or less, and yet substantially retain their amorphous atomic structure. As such, they can be produced in thicknesses of 1.0 mm or more, substantially thicker than conventional amorphous alloys, which are typically limited to thicknesses of 0.020 mm, and which require cooling rates of $10^5$ K/sec or more. U.S. Pat. Nos. 5,288,344; 5,368,659; 5,618,359; and 5,735,975, the disclosures of which are incorporated herein by reference in their entirety, disclose such bulk solidifying amorphous alloys.

In contrast to ordinary crystalline metals and alloys, no discernable pattern exists in the atomic structure of bulk solidifying amorphous alloys. As a result, bulk-solidifying amorphous alloys have typically high strength and high hardness. For example, Zr and Ti-base amorphous alloys typically have yield strengths of 250 ksi or higher and hardness values of 450 Vickers or higher. The ferrous-base version of these alloys can have yield strengths up to 500 ksi or higher and hardness values of 1000 Vickers and higher. As such, these alloys display excellent strength-to-weight ratio especially in the case of Ti-base and Fe-base alloys. Furthermore, bulk-solidifying amorphous alloys have good corrosion resistance and environmental durability, especially the Zr and Ti based alloys. Amorphous alloys generally have high elastic strain limit approaching up to 2.0%, much higher than any other metallic alloy.

In general, crystalline precipitates in bulk amorphous alloys are highly detrimental to the properties of amorphous alloys, especially to the toughness and strength of these alloys, and as such it is generally preferred to minimize the volume fraction of these precipitates. However, there are cases in which, ductile crystalline phases precipitate in-situ during the processing of bulk amorphous alloys, which are indeed beneficial to the properties of bulk amorphous alloys, especially to the toughness and ductility of the alloys. Such bulk amorphous alloys comprising such beneficial precipitates are also included in the embodiments herein. One exemplary case is disclosed in (C. C. Hays et. al, Physical Review Letters, Vol. 84, p 2901, 2000), which is incorporated herein by reference.

Accordingly, the radiation shielding structure can be constructed from bulk solidifying amorphous alloys in whole, or various components of radiation shielding structure can be made of bulk solidifying amorphous alloys. The high strength, high hardness, corrosion resistance, and wear resistance of bulk solidifying amorphous alloys can provide a high structural integrity and durability against mechanical and environmental intrusions. The size and shape of the radiation shielding structure and components will depend on the specific functions of the components as in the given examples below. The use of bulk solidifying amorphous alloys allows such structure and component dimensions from 0.1 mm thickness up to several mm thickness providing high structural integrity and effective shielding form radiation.

The shielding effectiveness for any radiation shielding structure can be mathematically described by Equation 1:

$$I/I_o=\exp(-\mu t), \quad \text{Eq. 1}$$

in which $I_o$ is the incident radiation intensity, I is the exiting radiation intensity, μ is the linear attenuation coefficient, and t is thickness of the shielding wall respectively. Generally, μ correlates with higher atomic number and higher density, and a larger μ reflects a higher shielding effectiveness. Bulk-solidifying amorphous alloys generally have a multi-component chemical composition, which can be optimized for this property by aiming high atomic number and high density. The amorphous structure typically has a random dense packing of individual atoms, therefore typically lacks any directionality in its properties. As such the shielding effectiveness of bulk amorphous alloys correlates with the average atomic number of its constituent elements without any complications from directionality.

The composition of the bulk solidifying amorphous alloy can be adjusted to have atoms with higher atomic number to improve shielding effectiveness without substantially compromising physical properties such as high strength, high hardness, high elastic limit, and high corrosion resistance. Furthermore, the methods used in fabricating near-to-net shape components of bulk amorphous alloys can still be utilized as described below. This is in distinct contrast to ordinary metals and alloys of steel, titanium, and aluminum where substantial alloying by the additions of heavy elements, such as tungsten, tantalum, hafnium, and zirconium generally compromises the high performance characteristics of such alloys. For example, Zr-base bulk amorphous alloys generally have a higher average atomic number than typical steel and as such have more effective radiation shielding. Moreover, in such alloys the zirconium can be substituted by hafnium in substantial amounts further increasing the effectiveness of radiation shielding.

The advantages of radiation shielding structures comprising bulk solidifying amorphous alloys can be particularly seen in structures requiring compact packaging and designs. The limitations of the conventional materials discussed are reflected in these structures by bulkier designs and packages compromising the performance and functionality of such structures and components. For example, in the case of structures made of titanium, aluminum, or steel, the inferior radiation shielding of these materials is not sufficiently effective (due to lower atomic number) and therefore thicker layers of the materials must be utilized, resulting in bulkier designs and packages, even though the general mechanical and physical properties of these alloys would normally be adequate for their intended use. On the other hand, even though tungsten and tantalum are excellent radiation shielding materials, the difficulty of fabrication, higher cost, and relatively low strength of tantalum precludes the manufacture of effective designs and packages. Meanwhile, tungsten impregnated plastic doesn't have sufficient strength; therefore requiring the structure to be bulkier and thicker. Moreover, although the structure is thicker, since the wall is mostly plastic, the radiation shield is compromised.

Bulkiness in certain radiation shielding structures is highly undesirable because it can potentially hinder the operation of the device and the success of its operation. For example, while a load lock gate or a robotic arm needs to have sufficient strength to avoid damage, it also is optimal to provide such a device with a compact structure to ensure that is can move in a confined space. Reducing weight and bulkiness when shielding of microelectronic devices (such as portable electronics, biological implants, medical devices, research equipment) is also advantageous. The BMT casting process allows elimination of all unnecessary bulk from the part design, since the part geometry is not limited by traditional machining techniques.

The compact design and packaging of these shielding devices also add to the ease of operation, particularly for medical equipment and procedures. For example, FIG. 1(*c*) provides a schematic diagram of a loading unit for feeding radioactive pills into a syringe or catheter during brachytherapy. Because this delivery tool contains a multiplicity of the radiation sources it must be shielded to prevent accidental emission of radiation to unwanted areas or to healthy cells of the medical service providers and the patients. Although one could conceivably construct such a device out of conventional materials, a bulky catheter or needle would require a larger incision and larger wound, which in turn would extend the recovery time and reduce the quality of life to the patient. In addition, a larger than desired brachytherapy device can hinder the ease of operation and the precise direction of the measured radiation doses into the intended areas. Bulk solidifying amorphous alloys, with high strength and elastic limit, allow formation of compact delivery structures with great stability that can improve the ease of the operation.

Corrosion and wear resistance is also extremely important for a medical device with moving parts. For example, in the brachytherapy device shown in FIG. 1(*c*), the components need to resist a variety of chemicals used in the hospital, to shield the radiation, and to have sufficient strength and compactness for performing a smooth operation. The high corrosion resistance of bulk solidifying amorphous alloy is very important in such structures and components, specifically for radiation shielding structure. A highly corrosion resistance device allows the operation to be safer and the device can be reused after a simple sterilization process. Wear resistance is another advantage of using bulk solidifying amorphous alloy because the components can maintain their tight tolerances during their lifetime.

For example, a load lock device for a radioactive container may require frequent opening and closing and therefore, the structure may comprise several moving parts and frames. Therefore, it is important that the components of such radiation shielding structures are closely mated with minimum gaps along the matching surfaces. The use of bulk-solidifying amorphous alloys has two distinct advantages in these structures. First, they can be net-shape fabricated into high tolerance dimensions at lower cost. Secondly, due to the high elastic limit and high strength of these materials such dimensional tolerances can be retained over the lifetime of the component. With lower strength materials the repeated use of such components can result in deformation and distortion over time reducing their performance and shielding effectiveness due to increased gaps among the components. Furthermore, the high corrosion resistance of the bulk solidifying amorphous alloys precludes the deterioration of such mating surfaces and prevents radiation leakage due to corrosion. The higher wear resistance of the bulk solidifying amorphous alloys can also be used in moving components with intimate contact and minimal gap without excessive wearing of the contact surfaces.

In another form, the radiation shielding structures can used as marker in radiography, such as imaging and locating orthopedic devices (stents etc.) in the body or locating tumors in Proton Beam Therapy. The high radiation shielding of bulk-solidifying amorphous alloy can provide very high contrast imaging, especially against the background of body tissue or next to other medical devices in the body. In this case, the radiography marker is desired to be highly biocompatible, and have high atomic number. This application relates to x-ray, gamma cameras, single positron emission tomography (SPECT), positron emission tomography (PET), computed tomography (CT), and other line-of-sight imaging technologies. Preferably, the weighted average (weighted per atomic percentages of elemental metals) of atomic number of bulk solidifying amorphous alloy is more than 40 in this type of application.

There are also advantages in the fabrication of complicated and intricate designs of radiation shielding structures and components using bulk solidifying amorphous alloys. The shrinkage of bulk solidifying amorphous alloys during casting or molding is very small; therefore, the as cast component can be used with minimal post-finishing. Furthermore, geometric factors such as ribs can be incorporated into the structure for better structural integrity. The bulk-solidifying amorphous alloy radiation shielding structures and components can be fabricated by either casting the amorphous alloys or molding the amorphous alloys.

One exemplary method for producing radiation shielding structures using a casting process is shown in the flowchart in FIG. 1(*d*), and comprises the following steps.

1) Providing a homogeneous alloy feedstock of amorphous alloy (not necessarily amorphous) and heating the feedstock to a casting temperature above the melting temperatures;

2) Introducing the molten alloy into shape-forming mold;

3) Quenching the molten alloy to temperatures below glass transition at sufficiently fast cooling rates; and 4) Final finishing Bulk amorphous alloys retain their fluidity from above the melting temperature down to the glass transition temperature due to the lack of a first order phase transition. This is in direct contrast to conventional metals and alloys. Since, bulk amorphous alloys retain their fluidity, they do not accumulate significant stress when cooled from their casting temperatures down to below the glass transition temperature, and as such dimensional distortions from thermal stress gradients can be minimized. Accordingly, intricate structures with large surface area and small thickness can be produced cost-effectively.

One exemplary method for producing radiation shielding structures using a molding process is shown in the flowchart in FIG. 1(*e*), and comprises the following steps.

1) Providing a sheet feedstock of amorphous alloy being substantially amorphous, and having an elastic strain limit of about 1.5% or greater and having a ΔT of 30° C. or greater;

2) Heating the feedstock to around the glass transition temperature;

3) Shaping the heated feedstock into the desired shape;

4) Cooling the formed component to temperatures far below the glass transition temperature; and 5) Final finishing.

Herein, ΔT is given by the difference between the onset of crystallization temperature, $T_x$, and the onset of glass transition temperature, $T_g$, as determined from standard DSC (Differential Scanning calorimetry) measurements at typical heating rates (e.g. 20° C./min).

Preferably ΔT of the provided amorphous alloy is greater than 60° C., and most preferably greater than 90° C. Moreover, the time and temperature of the heating and shaping operation is selected such that the elastic strain limit of the amorphous alloy is substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_x$. The cooling step is carried out at rates similar to the heating rates at the heating step, and preferably at rates greater than the heating rates at the heating step. The cooling step is also achieved preferably while the forming and shaping loads are still maintained.

Many BMG alloys with high-Z numbers and/or electromagnetic properties which make them appropriate for electromagnetic shielding applications have already been discovered. When measuring the stopping power of a material, the quantity "delta I" (ΔI) is the difference in radiant intensity before and after the shield. This value is known to be proportional to the cube of the atomic number Z, of the element doing the blocking. The table below gives estimates of the blocking power of several example BMG alloys. The average Z number for each material based on the atomic % of each constituent the Z3 value for each alloy, and also a comparison of each alloy's stopping power with that of Lead, a very common shielding component by calculating a percentage of Lead's stopping power. None of the materials cited have a stopping power as high as Lead for gamma-rays, but are much more environmentally and biologically friendly, and can be used in bio-applications where lead is entirely inappropriate. Other high-Z alloys are also feasible. For non-ionizing radiation, the shielding properties of the material are determined by its conductivity, permeability, and thickness. In the table below, a theoretical skin-depth (depth at which the radiation falls to 1/e of its original intensity) is calculated based on the primary constituent of the alloy. This is a rough approximation due to the amorphous nature of BMG materials, but gives an initial estimate where empirical data is lacking. The complete electromagnetic properties of many BMG alloys are unexplored. A combination of higher conductivity and permeability in a BMG alloys reduces the skin depth of the material, and therefore reduces the necessary thickness of a shield made from that material, consequently reducing cost, weight, and volume.

| Examples | Name | | | | | | Density (g/cc) | IONIZING DATA $\Delta^{1\alpha}Z^3$ intensity (Ave Z)^3 | Attenuation relative to Pb (Z^3 = 551368) | NON-IONIZING (RF) DATA Primary Constituent Resistivity | Estimated Skin Depth in mm at 100 MHz |
|---|---|---|---|---|---|---|---|---|---|---|---|
| RF + Ionizing Radiation (X-ray, Gamma) | | | | | | | | | | | |
| | Gold Based Alloys | | | | | | | | | | |
| Examples | Name | Au | Ag | Pd | Cu | Si | | | | | |
| | Au750 | 0.49 | 0.055 | 0.023 | 0.269 | 0.163 | 13.9 | 144174.57 | 26% | 2.44E−08 | 7.86E−06 |
| | Au16 | 0.509 | 0.03 | 0.023 | 0.278 | 0.16 | 13.9 | 148716.944 | 27% | 2.44E−08 | 7.86E−06 |
| | Copper Based Alloys | | | | | | | | | | |
| Example | | Cu | Hf | Al | | | | | | | |
| | Cu6-6 | 0.5 | 0.43 | 0.07 | | | 11.02 | 99703.7029 | 18% | 1.68E−08 | 6.52E−06 |
| Ionizing Radiation Only | | | | | | | | | | | |
| | Halfnium Based Alloys | | | | | | | | | | |
| Examples | Name | Hf | Nb | Cu | Ni | Al | | | | | |
| | X-6 | 0.48 | 0.05 | 0.244 | 0.126 | 0.1 | 11 | 114536.353 | 21% | 3.31E−07 | 2.89E−05 |
| | | Hf | Ta | Cu | Ni | Al | | | | | |
| | X-6Ta | 0.48 | 0.05 | 0.244 | 0.126 | 0.1 | 11.4 | 125857.0 | 23% | 3.31E−07 | 2.89E−05 |
| | Platinum Based Alloys | | | | | | | | | | |
| Example | Name | Pt | Cu | Ni | P | | | | | | |
| | Pt750 | 0.575 | 0.147 | 0.053 | 0.225 | | 15 | 157219.183 | 29% | 1.07E−07 | 1.65E−05 |
| RF Only | | | | | | | | | | | |
| Examples | Iron-Based Moieties: Fe—P—C—B, Fe—P—C—B—Si, Fe—Mo—P—C—B, Fe—Mo—Ni—P—C—B, Fe—Mo—Ni—Cr—P—C—B, etc. Nickle-Based System: Ni—Nb—Sn | | | | | | | | | | |
| c | | | | | | | | | | | |

One could use BMG materials for shielding applications for multiple reasons. The first reason is that with the different alloy compositions that one can make from the different atomic weight materials and the different amounts of each atomic weight material, one can come up with different conductivities for the BMG materials. So one can actually tune the conductivity of the materials to have a specific shielding property, and that would be especially useful for radio frequency in the kilohertz and megahertz regime.

The second reason is that one can tailor the density of the BMG material as desired. One is not limited to a single density of the material like of copper or steel or lead, but one can generate different materials with different densities. This shows that one can have different compositions of BMG materials that fall on the density scale in different places, and select a specific composition that would be suitable for a specific application.

The third reason would be the susceptibility of BMG materials, i.e., the magnetic susceptibility. Magnetic susceptibility ($\chi$) is the degree to which a material can be magnetized in an external magnetic field. If $\chi$ is positive, the material can be paramagnetic. In this case, the magnetic field in the material is strengthened by the induced magnetization. Alternatively, if $\chi$ is negative, the material is diamagnetic. As a result, the magnetic field in the material is weakened by the induced magnetization. Generally, non-magnetic materials are said para- or diamagnetic because they do not possess permanent magnetization without external magnetic field. On the far end of that scale, are materials that have high $\chi$ and can permanently magnetize. Ferromagnetic, ferrimagnetic, or antiferromagnetic materials, have high positive susceptibility, and possess permanent magnetization even without external magnetic field. Magnetic materials having different susceptibilities could be beneficial in different applications. Bulk metallic glasses would allow one to choose the material that has just the right amount of magnetization for a particular application.

The fourth reason is improved corrosion resistance, particularly against different environments, such as inside a human being or an animal. Even in an aqueous environment where there are ions that would eventually deteriorate other metals, or in an organic environment that is corrosive to the metal or any sort of harsh environmental conditions, BMGs tend to have good corrosion resistance.

The fifth reason is thermoplastic formability, thereby one can shield in very complex shapes. It is very easy to make a continuous shield without seems or without welding even for a complex shape that would shield whatever one wanted to put inside or outside. That is due to the forming processes that are available for thermoplastic forming the bulk metallic glasses. The thermoplastic forming processes could be hot forming or blow molding or extruding; they can produce different shapes fairly easily with the bulk metallic glasses.

The sixth reason is that one can process BMGs by thermoplastic forming at nano scale, micro scale and macro scale for radiation shielding for items such as bulk electronics or bulk radioactive fluids or whatever it would be.

The seventh reason that BMGs can be made to be non-toxic as compared to current shielding materials like lead.

FIG. 3 shows different forms of radiation shielding structures of bulk metallic glass. One can shield radiation from the inside out from a radiating source by enclosing the radiation source, for example, or shield from the outside in by enclosing the body that should be protected from radiation.

Item 1 is just a bulk form. One can have a wall that shields against particles or radiation so that one puts whatever one is trying to shield on one side of the wall and the radiation emitter would be on the other.

Item 2 is a foil, and that would be useful for wrapping components, or layering on top of something that one wanted to shield or rolling around something that one wanted to shield, but it would basically be a foil form of whatever bulk metallic glass one wanted to use.

Item 3 is a plating, and that is where one could use some method of deposition to deposit the bulk metallic glass on top of whatever structure one were trying to shield. It would not have to be a plate like that drawn in FIG. 3. It could be any shape but the goal there is to shield whatever is inside or plate an object that contains radiation to keep the radiation from going out. Please note that the plating or the substrate of Item 3, or the foil of Item 2, can all be patterned to give one specific patterns of transmission or reception of radiation and can also be used to tune reception or transmission or radiation in the case radio frequency waves or for whatever reason one wanted to pattern them.

Item 4 is a blow molded structure to shield radiation. Item 5 is a sealed container made by a hot forming process that can be used to form bulk metallic glasses. By a hot forming process, the two bulk metallic glass components can be sealed together to form a seal that would be the equivalent of a metal weld or a polymer bond, for example, using an epoxy or glue. The benefit of a hot formed seal is that the weld line would have the same shielding properties as the rest of the container so that there would be uniform shielding all the way around container. One can put whatever one is trying to protect inside the structure/container or one can put the radiation source inside of the structure/container so the radiation is contained within the structure.

Item 6 is a mesh form, for example, a Faraday cage type of setup, where the Faraday cage shields something from radiation but it is not a solid plate of material; instead, it is a fine wire mesh. Depending on the mesh size one could shield something from different frequencies of radiation. The structure of Item 6 could be a matrix of bulk metallic glass wires, and that can be in any shape. The mesh form shield could be woven into a plate or it could be kind of a spherical shape or any cage that surrounds some kind of device or object or person that needed to be protected.

Item 7 is a radio-frequency (RF) guide can designed from conductive bulk amorphous alloy materials using micro patterned surface to conduct radio frequency waves in a direction into or away from something, depending on what one is trying to do. One can either guide the waves to a specific region for use or one can guide them away from a specific region to protect oneself. A RF guide works due to these micro structures that happen to interact with certain wavelengths so one can tune it to a certain frequency. One can do this in the radio frequency regime, and potentially in the optical regime as well for certain materials. Left handed and right handed in the figure are referred to, left handed and right handed indexes of refraction. One can actually create left handed and negative index of refraction materials using this method of micro patterning conductive metals. While the figure shows RF flux being guided through the RF guide, i.e., RF frequencies and energy are being conducted through a bar of a RF guide. The reason that bulk metallic glasses could be use to make RF guides is because they are easily patterned, easily molded into the complex shapes and would not have to be manufactured by complex machining or etching or laser ablation or any other expensive method.

FIG. 4 shows how bulk metallic glasses would be useful in medical implants exposed to radiation, particularly comparing a zirconium based bulk metallic glass alloy with copper. The first row shows the magnetic susceptibility ($\chi$) of the two materials. For medical implants, one would prefer using something with a lower magnetic susceptibility, which means that it is going to have less of a magnetic response when it is put in an external magnetic field. So if one compares that magnetic susceptibility of the zirconium based bulk metallic glass compared with that of copper, one would choose the zirconium based bulk metallic glass because the latter has a lower magnetic susceptibility. For MRI imaging, if one would have a zirconium based bulk metallic glass inside somebody's body that is being imaged, one would get less artifacts from that piece of metal than from copper. So, if somebody has a pacemaker and it has got a piece that is made of a bulk metallic glass such as zirconium based bulk metallic glass, one would expect to see less interference due to that bulk metallic glass material in the MRI image than one would if one made it out of a material that had a higher magnetic susceptibility.

FIG. 5 shows applications of bulk metallic glass for radiation shielding for electronics and microelectronics, meaning kind of component level electronics, resisters, capacitors, inductors, even small integrated circuits or CPUs, anything that would be used in a circuit board. These components could be shielded by a bulk metallic glass, foil, or deposited layer, or a bulk piece of material that was molded around a component. So applications could be to protect components against, for example, radio frequency or even higher frequency radiation, such as gamma rays or cosmic rays. One can also protect electronics on the board level, meaning the PCB (printed circuit board) level. One could design with foil or with bulk molding techniques designed shielding that goes around board level electronics so that the components are protected again against radio frequency, interference or even X-rays and gamma rays. FIG. 5 shows a PCB entirely enclosed by a BMG coating or layer, for example, where the whole device would be encased by a bulk metallic glass shield. For example, the component could be for phones or other electronic equipment that is sensitive to electromagnetic radiation, such as microphones or motors or anything that transmits or receives, such as a speaker or transducer or something along those lines.

Shielding Design

Shielding reduces the intensity of radiation exponentially depending on the thickness. This means when added thicknesses are used, the shielding multiplies. For example, a practical shield in a fallout shelter is ten halving-thicknesses of packed dirt, which is 90 cm (3 ft) of dirt. This reduces gamma rays to $1/1{,}024$ of their original intensity (½ multiplied by itself ten times). Halving thicknesses of some materials, that reduce gamma ray intensity by 50% (½) include:

| Material | Halving Thickness, inches | Halving Thickness, cm | Density, g/cm$^3$ | Halving Mass, g/cm$^2$ |
|---|---|---|---|---|
| lead | 0.4 | 1.0 | 11.3 | 12 |
| concrete | 2.4 | 6.1 | 3.33 | 20 |
| steel | 0.99 | 2.5 | 7.86 | 20 |
| packed soil | 3.6 | 9.1 | 1.99 | 18 |
| water | 7.2 | 18 | 1.00 | 18 |
| lumber or other wood | 11 | 29 | 0.56 | 16 |
| air | 6000 | 15000 | 0.0012 | 18 |

Column Halving Mass in the chart above indicates mass of material, required to cut radiation by 50%, in grams per square centimeter of protected area. The effectiveness of a shielding material in general increases with its density. As explained above, the density of bulk-solidifying amorphous alloys can be tailored as desired, thereby allowing one to make radiation shielding structures having different radiation shielding effectiveness.

Graded-Z Shielding

Graded-Z shielding is a laminate of several materials with different Z values (atomic numbers) designed to protect against ionizing radiation. Compared to single-material shielding, the same mass of graded-Z shielding has been shown to reduce electron penetration over 60%. It could be used to in satellite-based particle detectors, offering several benefits: protection from radiation damage; reduction of background noise for detectors; and lower mass compared to single-material shielding.

Designs vary, but could involve a gradient from high-Z (e.g., tantalum) through successively lower-Z elements such as tin, steel, and copper, usually ending with aluminum. Sometimes even lighter materials such as polypropylene or boron carbide could be used.

In an embodiment of a graded-Z shield, the high-Z layer effectively scatters protons and electrons. It also absorbs gamma rays, which produces X-ray fluorescence. Each subsequent layers absorbs the X-ray fluorescence of the previous material, eventually reducing the energy to a suitable level. Each decrease in energy produces bremsstrahlung and Auger electrons, which are below the detector's energy threshold. Some designs also include an outer layer of aluminum, which may simply be the skin of the satellite.

What is claimed:

1. A radiation shielding structure comprising a bulk-solidifying amorphous alloy, wherein the radiation shielding structure is configured to provide radiation shielding and the bulk-solidifying amorphous alloy includes less than 5% by atomic weight tungsten and is lead free and biocompatible and wherein the weighted average of atomic number of bulk solidifying amorphous alloy is more than 40 and the density of bulk solidifying amorphous alloy is more than 8.0 g/cc.

2. The radiation shielding structure of claim 1, wherein the weighted average of atomic number as weighted per atomic percentages of elemental metals of bulk solidifying amorphous alloy is more than 50.

3. The radiation shielding structure of claim 1, wherein the radiation shielding structure comprises a net shaped cast component comprising the bulk-solidifying amorphous alloy.

4. The radiation shielding structure of claim 1, wherein the radiation shielding structure comprises a net shaped molded component comprising the bulk-solidifying amorphous alloy.

5. The radiation shielding structure of claim 1, wherein the radiation shielding structure comprises a net shaped thermoformed component comprising the bulk-solidifying amorphous alloy.

6. The radiation shielding structure of claim 1, wherein the bulk-solidifying amorphous alloy comprises a Zr—Hf base bulk solidifying amorphous alloy.

7. The radiation shielding structure of claim 1, wherein the bulk-solidifying amorphous alloy comprises a Zr base bulk solidifying amorphous alloy.

8. The radiation shielding structure of claim 1, wherein the bulk-solidifying amorphous alloy is Be free.

9. The radiation shielding structure of claim 1, wherein the bulk-solidifying amorphous alloy comprises a Zr/Ti base bulk-solidifying amorphous alloy with in-situ ductile crystalline precipitates.

10. The radiation shielding structure of claim 1, wherein the bulk-solidifying amorphous alloy comprises a Hf-base bulk solidifying amorphous alloy.

11. The radiation shielding structure of claim 1, wherein the bulk-solidifying amorphous comprises a bio-compatible bulk solidifying amorphous alloy having a biocompatibility of a radiography marker.

12. The radiation shielding structure of claim 1, wherein the radiation shielding structure comprises an electronic or microelectronic radiation shielding structure.

13. The radiation shielding structure of claim 1, wherein the radiation shielding structure comprises a cell phone radiation shielding structure.

14. A radiography marker made of a bio-compatible bulk solidifying amorphous alloy including less than 5% by atomic weight tungsten and wherein the weighted average of atomic number as weighted per atomic percentages of elemental metals of bulk solidifying amorphous alloy is more than 40.

15. A method of making a radiation shielding structure comprising:

shaping a bulk-solidifying amorphous alloy in a near-to-net shaped form, the bulk-solidifying amorphous alloy including less than 5% by atomic weight tungsten and being lead free and biocompatible and wherein the weighted average of atomic number of bulk solidifying amorphous alloy is more than 40 and the density of bulk solidifying amorphous alloy is more than 8.0 g/cc; and forming the radiation shielding structure.

16. The method of claim 15, further comprising:

obtaining a molten metal alloy at or above Tm; and introducing the molten metal alloy into a die cavity; and cooling the molten metal alloy to form the bulk-solidifying amorphous alloy.

17. The method of claim 15, further comprising:

obtaining the bulk-solidifying amorphous alloy; and heating the bulk-solidifying amorphous alloy to above Tg, but below Tx.

* * * * *